US007500877B2

(12) United States Patent
Masumoto et al.

(10) Patent No.: US 7,500,877 B2
(45) Date of Patent: Mar. 10, 2009

(54) ELECTRICAL CONNECTOR HAVING A SHELL

(75) Inventors: Toshio Masumoto, Tokyo (JP); Kan Ozawa, Tokyo (JP); Minoru Urano, Tokyo (JP); Fumio Yaguchi, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 11/985,874

(22) Filed: Nov. 16, 2007

(65) Prior Publication Data

US 2008/0139049 A1 Jun. 12, 2008

(30) Foreign Application Priority Data

Dec. 7, 2006 (JP) ..... 2006-331082
Feb. 15, 2007 (JP) ..... 2007-035265

(51) Int. Cl.
*H01R 13/648* (2006.01)

(52) U.S. Cl. ..... 439/607

(58) Field of Classification Search ..... 439/607, 439/609, 746; 174/35 R
See application file for complete search history.

(56) References Cited

U.S. PATENT DOCUMENTS 5,017,158 A * 5/1991 Liu et al. ..... 439/609
5,028,740 A * 7/1991 Tomiya ..... 174/373
6,077,118 A 6/2000 Harada et al.

FOREIGN PATENT DOCUMENTS

JP 2-593552 2/1999
JP 3-803837 5/2006

* cited by examiner

*Primary Examiner*—Chandrika Prasad
(74) *Attorney, Agent, or Firm*—Collard & Roe, P.C.

(57) ABSTRACT

A shell covering a housing has a shell body portion and a first and a second joining portion joining both ends of the shell body portion to each other. The first joining portion has a projecting portion projecting from a first end portion of the shell body portion and a recessed portion formed at a second end portion of the shell body portion and engaging with the projecting portion. The second joining portion has a first overlapping portion and a second overlapping portion that are overlapped with each other. The first overlapping portion is part of the first end portion and the second overlapping portion is part of the second end portion. An opening is formed at the first overlapping portion and a caulking portion is formed at the second overlapping portion. The opening and the caulking portion engage with each other by caulking the caulking portion.

5 Claims, 5 Drawing Sheets

ELECTRICAL CONNECTOR HAVING A SHELL

This application is based upon and claims the benefit of priority from Japanese patent applications No. 2006-331082, filed on Dec. 7, 2006 and No. 2007-35265, filed Feb. 15, 2007, the disclosures of which are incorporated herein in their entirety by reference.

BACKGROUND OF THE INVENTION

This invention relates to an electrical connector having a shell fitted over a housing.

As related art, Japanese Utility Model Registration No. 2593552 (JP-Y) (Patent Document 1) describes an outer conductor of a coaxial connector, which is formed into a hollow cylindrical shape by bending a metal plate.

The outer conductor is formed by bending the metal plate and butting and joining both end sides thereof together. One of the end sides of the metal plate has a dovetailed projecting portion with a widened end and the other end side has a corresponding cutout portion, wherein the dovetailed projecting portion is fitted into the cutout portion with no space therebetween so that both are joined together. The outer conductor has portions applied with a crushing process near the end sides of the metal plate.

On the other hand, as another related art, Japanese Patent No. 3803837 (JP-B) (Patent Document 2) describes an electrical connector having a metal shell fitted over a housing.

The shell is formed by bending a metal plate into a hollow rectangular parallelepiped. Both end portions of the metal plate are overlapped with each other to form a joined portion at the bottom of the shell. The thickness of the joined portion is substantially equal to that of the other part of the metal plate.

One of the end portions of the metal plate is pressed to a thickness half that of the metal plate to thereby form a stepped joining edge portion and the other end portion is also pressed to a thickness half that of the metal plate to thereby form a stepped joining edge portion. These joining edge portions are overlapped and joined together to form the joined portion.

In Patent Document 1, the thickness of each of the end sides of the metal plate is equal to that of the other part of the metal plate. Therefore, there is a problem that when the outer conductor is required to have a greater strength against a load such as a pinch force, the coaxial connector cannot ensure a structurally sufficient strength.

In Patent Document 2, the thickness of each of the joining edge portions of the metal plate is half that of the other part of the metal plate. Therefore, since the thickness of the joined portion is equal to that of the other part of the metal plate, there is a problem that it is not possible to obtain a structurally sufficient strength required for the shell.

Further, in Patent Document 2, since both end portions of the metal plate are each pressed to the thickness half that of the other part of the metal plate by a crushing process, there is a problem that the shape and material are limited.

SUMMARY OF THE INVENTION

It is therefore an object of this invention to provide an electrical connector that can improve the strength of a joined portion of a shell.

According to this invention, there is provide an electrical connector comprising a contact, a housing holding said contact, and a shell covering said contact and said housing, wherein said shell comprises a shell body portion and a joining portion joining both ends of said shell body portion to each other, said joining portion comprises a first joining portion and a second joining portion, said first joining portion comprises a projecting portion projecting from a first end portion and a recessed portion formed at a second end portion (33*f*) and engaging with said projecting portion, said second joining portion comprises a first overlapping portion and a second overlapping portion that are overlapped with each other, said first overlapping portion being part of said first end portion and said second overlapping portion being part of said second end portion, an opening is formed at one of said first and second overlapping portions and a caulking portion is formed at the other of said first and second overlapping portions, and said caulking portion is inserted in said opening and caulked, so that said opening and said caulking portion engage with each other.

DESCRIPTION OF THE PREFERRED EMBODIMENTS

First Embodiment

Figure 1:
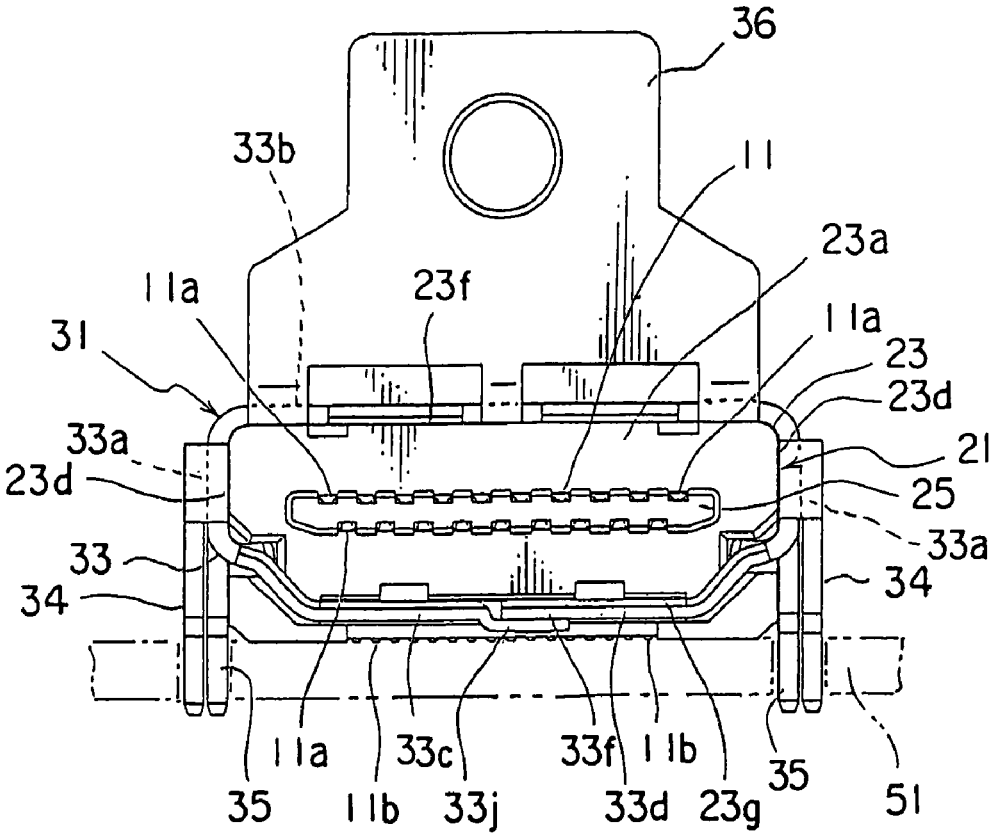
FIG. 1 is a front view showing an electrical connector of a first embodiment according to this invention.

FIGS. 1 to 5 show a connector of a first embodiment according to this invention. Referring to FIGS. 1 to 5, the connector comprises conductive contacts 11, an insulating housing 21 holding the contacts 11, and a metal shell 31 covering the outside of the housing 21.

The contacts 11 are each formed by applying bending to a belt-like metal plate. The contacts 11 are arranged at regular intervals and incorporated into the housing 21.

The housing 21 is formed of a resin material. The housing 21 comprises a generally rectangular parallelepiped housing body 23 and a plate-like fitting portion 25 formed on a surface 23*a* of the housing body 23 so as to project therefrom.

Figure 4:
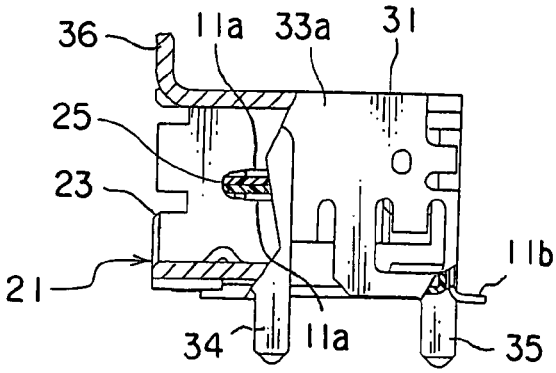
FIG. 4 is a right side sectional view of the electrical connector shown in FIG. 1, wherein the electrical connector is shown with its attaching portion being omitted and is partly sectioned.
Figure 5:
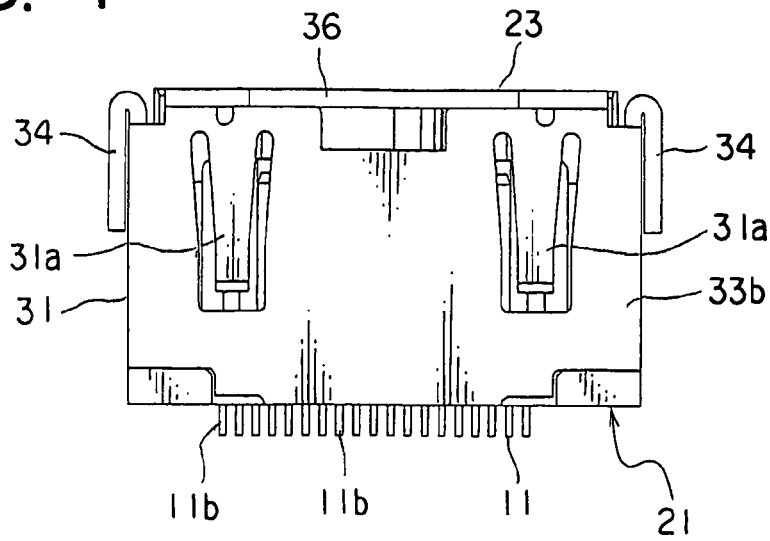
FIG. 5 is a plan view of the electrical connector shown in FIG. 1.

Contact portions 11*a* on one end side of the contacts 11 are disposed on an upper surface and a lower surface, opposed thereto, of the fitting portion 25. As shown in FIGS. 1 and 4, the contact portions 11*a* are aligned in a row on the upper surface of the fitting portion 25 and, likewise, the contact portions 11*a* are aligned in a row on the lower surface of the fitting portion 25. Accordingly, the contact portions 11*a* are arranged in two rows on the upper and lower surfaces of the fitting portion 25.

The fitting portion 25 is fitted to a mating fitting portion of a mating connector (not shown) serving as a plug side. The mating fitting portion is provided with mating contact portions of mating contacts to which cables (not shown) are connected. The contact portions 11*a* and the mating contact portions are connected together when the fitting portion 25 and the mating fitting portion are fitted together.

From another surface, opposed to the surface 23*a*, of the housing body 23, terminal portions 11*b* of the contacts 11 extend out to the exterior of the housing body 23. After the connector is mounted on a printed circuit board 51 shown in FIG. 1, the terminal portions 11*b* are connected to a signal transmission circuit of the printed circuit board 51 by soldering.

The shell 31 comprises a shell body portion 33 formed into a generally hollow rectangular parallelepiped shape and a pair of first leg portions 34 provided continuously to an open side of the shell body portion 33 at its one end. The shell 31 further comprises a pair of second leg portions 35 each provided continuously to a corresponding one of a pair of side plate portions 33*a* of the shell body portion 33, and an attaching portion 36 connected to an upper plate portion 33*b* of the shell body portion 33.

Each first leg portion 34 is bent so as to face an outer surface of the corresponding side plate portion 33*a* and extends downward more than the shell body portion 33. Each second leg portion 35 projects outward from the corresponding side plate portion 33*a*. A tip portion of each second leg portion 35 also extends downward more than the shell body portion 33. The attaching portion 36 extends upward in a direction perpendicular to the upper plate portion 33*b*.

The first and second leg portions 34 and 35 are inserted into insertion holes (not shown) formed in the printed circuit board 51 shown in FIG. 1 so as to be connected to a ground circuit (not shown) of the printed circuit board 51. The attaching portion 36 is attached to a case of a device (not shown) for ground connection.

The shell body portion 33 is attached to the housing body 23 so as to surround the outer periphery of the housing body 23. That is, the shell body portion 33 has the pair of side plate portions 33*a*, the upper plate portion 33*b*, and a pair of first and second joining plate portions 33*c* and 33*d*.

Each side plate portion 33*a* of the shell body portion 33 is located outside a corresponding one of a pair of side surfaces 23*d*, opposed to each other, of the housing body 23. An upper surface 23*f* of the housing body 23 is opposed to a lower surface 23*g* of the housing body 23. The upper plate portion 33*b* of the shell body portion 33 is located outside the upper surface 23*f* of the housing body 23. The first and second joining plate portions 33*c* and 33*d* are opposed to the upper plate portion 33*b* of the shell body portion 33. Further, the first and second joining plate portions 33*c* and 33*d* are located so as to face the lower surface 23*g* of the housing body 23.

Normally, the shell 31 is formed by conveying a metal plate, prepared in the form of a roll, into a press machine and bending the metal plate into a generally hollow rectangular parallelepiped shape by the press machine to obtain the shell body portion 33. The shell body portion 33 requires a joining portion joining together an end portion 33*e* of the first joining plate portion 33*c* and an end portion 33*f* of the second joining plate portion 33*d* at the position just under the lower surface 23*g* of the housing body 23.

The joining portion comprises a first joining portion and a second joining portion.

Figure 2:
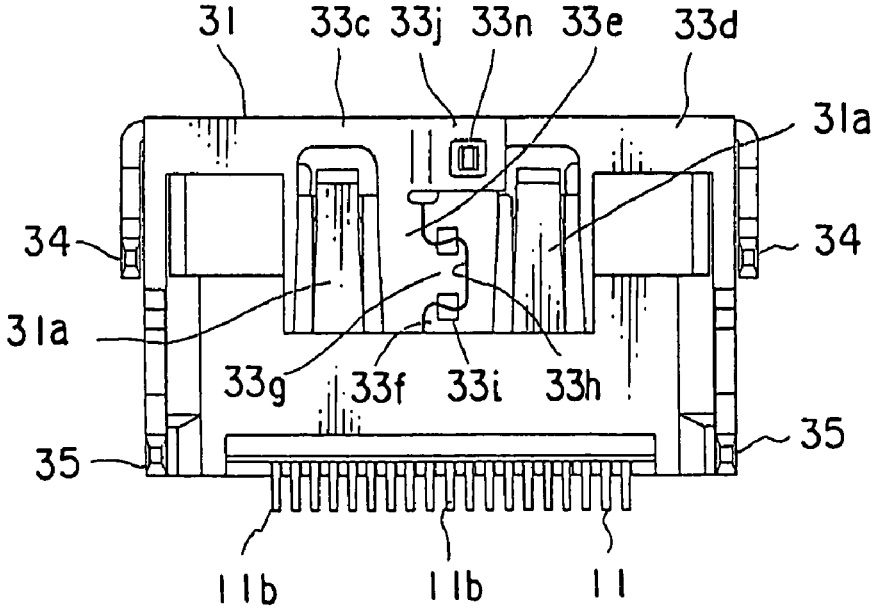
FIG. 2 is a bottom view of the electrical connector shown in FIG. 1.
Figure 3:
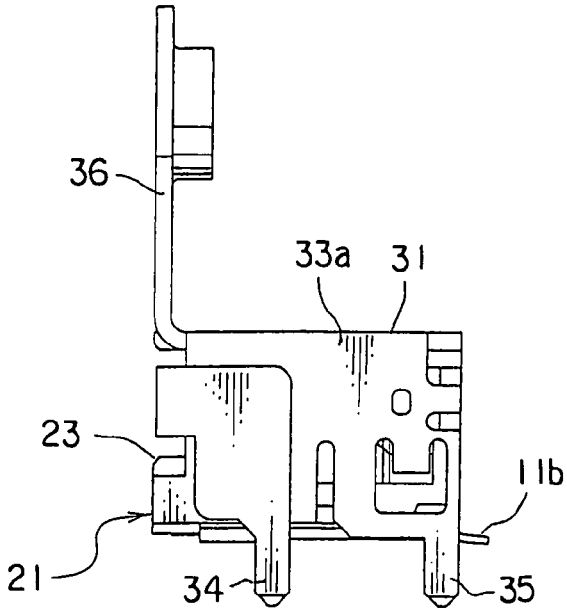
FIG. 3 is a right side view of the electrical connector shown in FIG. 1.

As shown in FIG. 2, the first joining portion comprises a projecting portion 33*g* formed so as to project outward from an edge of the end portion 33*e* of the first joining plate portion 33*c*. The first joining portion further comprises a recessed portion (cutout portion) 33*h* formed at an edge of the end portion 33*f* of the second joining plate portion 33*d* so as to engage with the projecting portion 33*g*. The projecting portion 33*g* and the recessed portion 33*h* engage with each other so that the edges of the first and second joining plate portions 33*c* and 33*d* are butted to each other to make the plate surfaces of the first and second joining plate portions 33*c* and 33*d* flush with each other.

It is expected that a large clearance is formed at a butted portion between the projecting portion 33*g* and the recessed portion 33*h*. In this event, at the butted portion between the projecting portion 33*g* and the recessed portion 33*h*, crushed portions 33*i* are formed by crushing portions of the first and second joining plate portions 33*c* and 33*d* so as to bridge across the projecting portion 33*g* and the recessed portion 33*h*. When the crushed portions 33*i* are formed, the projecting portion 33*g* and the recessed portion 33*h* are partially pushed out between the projecting portion 33*g* and the recessed portion 33*h* by the crushing process. Since this makes it possible to minimize the clearance at the butted portion between the projecting portion 33*g* and the recessed portion 33*h*, it is possible to increase the joining strength of the shell body portion 33.

Figure 6:
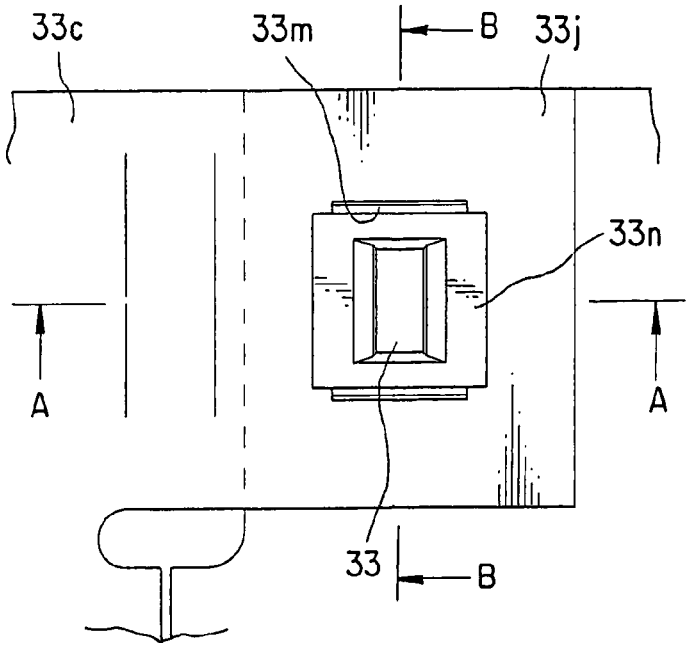
FIG. 6 is a bottom view enlargedly showing an overlapped portion of the electrical connector shown in FIG. 2.
Figure 7:
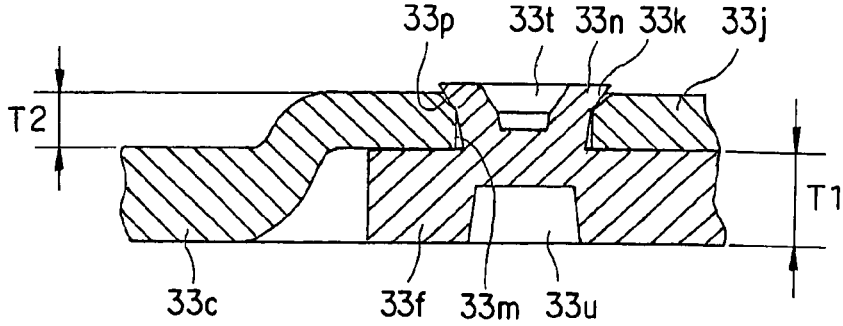
FIG. 7 is a sectional view taken along line A-A in FIG. 6.
Figure 8:
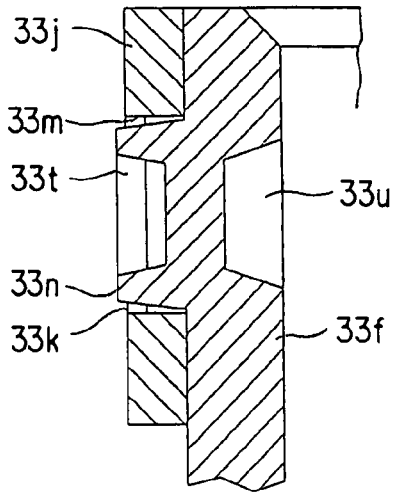
FIG. 8 is a sectional view taken along line B-B in FIG. 6.

FIG. 6 is a bottom view enlargedly showing an overlapped portion of the electrical connector shown in FIG. 2. FIG. 7 shows a section taken along line A-A in FIG. 6 and FIG. 8 shows a section taken along line B-B in FIG. 6. As shown in FIGS. 2, 6, 7, and 8, the second joining portion is located near the first joining portion comprising the projecting portion 33*g* and the recessed portion 33*h*.

The end portion 33*e* of the first joining plate portion 33*c* is formed with an extended portion (a first overlapping portion) 33*j* extending from the end portion 33*e*. The extended portion 33*j* and the end portion (a second overlapping portion) 33*f*, facing the extended portion 33*j*, of the second joining plate portion 33*d* are overlapped with each other.

The extended portion 33*j* is part of the end portion 33*e* of the first joining plate portion 33*c*. The extended portion 33*j* overlaps to cover part of the end portion 33*f* of the second joining plate portion 33*d*. The extended portion 33*j* is formed with an opening 33*m*. The end portion 33*f* of the second joining plate portion 33*d* is formed with a convex caulking portion 33*n*.

The opening 33*m* has chamfered portions 33*k* formed so as to expand inner walls of the opening 33*m* on its upper edge side. The caulking portion 33*n* is inserted in the opening 33*m*. The caulking portion 33*n* is caulked so that it engages with the opening 33*m*. Thus, the extended portion 33*j* engages with the caulking portion 33*n*. Each chamfered portion 33*k* of the opening 33*m* is in the form of a tapered surface sloping planarly or a curved surface. The caulking portion 33*n* is formed with chamfered portions 33*p* on its outer side for ensuring smooth caulking at the time of caulking the caulking portion 33*n* to the edge sides of the opening 33*m*. A caulking groove 33*t* is formed on an upper surface in FIG. 7 of the caulking portion 33*n*. As shown in FIG. 8, the end portion 33*f* of the second joining plate portion 33*d* is formed with a groove 33*u* on its lower surface in FIG. 7 opposed to the caulking portion 33*n*. The groove 33*u* has a depth extending in a thickness direction of the end portion 33*f* of the second joining plate portion 33*d* from the lower surface in FIG. 7, opposed to the caulking portion 33*n*, of the end portion 33*f*.

The caulking portion 33*n* is caulked so as to be crushed to the sides of the chamfered portions 33*k* of the opening 33*m*, thereby being joined to the extended portion 33*j*. Therefore, the caulking portion 33*n* serves to improve the joining force between the end portion 33*f* of the second joining plate portion 33*d* and the extended portion 33*j* serving as overlapping portions cooperatively forming an overlapped and joined portion of the shell body portion 33.

The projecting portion 33*g* and the recessed portion 33*h* of the first and second joining plate portions 33*c* and 33*d* may be joined together in a reverse relationship in shape. Further, the extended portion 33*j* and the end portion 33*f* of the second joining plate portion 33*d* may be arranged in a reverse manner such that the caulking portion 33*n* is formed at the extended portion 33*j* while the opening 33*m* is formed at the end portion 33*f* of the second joining plate portion 33*d* and both are joined together in the manner as described above.

As shown in FIG. 7, a thickness T1 of the end portion 33*f* of the second joining plate portion 33*d* is set equal to the thickness of the shell body portion 33. A thickness T2 of the extended portion 33*j* of the first joining plate portion 33*c* is set smaller than the thickness T1, thereby suppressing the total thickness of the end portion 33*f* of the second joining plate portion 33*d* and the extended portion 33*j*.

It may be configured that the thickness of the end portion 33*f* of the second joining plate portion 33*d* shown in FIG. 7 is set to T2 and the thickness of each of the first and second joining plate portions 33*c* and 33*d* is set equal to the thickness of the shell body portion 33. Further, it may be configured that the thickness of the extended portion 33*j* of the first joining plate portion 33*c* is set smaller than T2, thereby suppressing the total thickness of the end portion 33*f* of the second joining plate portion 33*d* and the extended portion 33*j*.

There are a total of four contact spring portions 31*a* formed at the upper plate portion 33*b* and the first and second joining plate portions 33*c* and 33*d* of the shell 31. The contact spring portions 31*a* serve to ensure elastic contact with a mating shell (not shown) of the mating connector for connection thereto.

Second Embodiment

Figure 9:
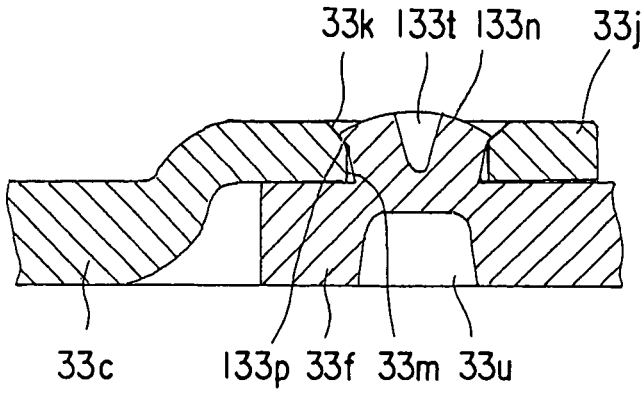
FIG. 9 is a sectional view showing an electrical connector of a second embodiment according to this invention, wherein there is shown a modification of the overlapped portion shown in FIGS. 6 to 8.

FIG. 9 shows a connector of a second embodiment according to this invention. The second embodiment includes a modification of the caulking portion 33*n* formed at the end portion (a second overlapping portion) 33*f* of the second joining plate portion 33*d*, which is shown in FIGS. 6 to 8 of the first embodiment.

An end portion 33*f* of a second joining plate portion 33*d* is formed with a convex caulking portion 133*n*. An opening 33*m* has chamfered portions 33*k* formed by expanding inner walls of the opening 33*m* on its upper edge side in FIG. 9.

The caulking portion 133*n* is inserted in the opening 33*m*. The caulking portion 133*n* is caulked at the opening 33*m* so that the caulking portion 133*n* and an extended portion 33*j* engage with each other.

The caulking portion 133*n* is formed with chamfered portions 133*p* on its outer side for ensuring smooth caulking at the time of caulking the caulking portion 133*n* to the edge sides of the opening 33*m*. An upper surface in FIG. 9 of the caulking portion 133*n* has a circular arc shape in section. A caulking groove 133*t* is formed on the upper surface in FIG. 9 of the caulking portion 133*n*. The end portion 33*f* of the second joining plate portion 33*d* is formed with a groove 33*u* on its lower surface in FIG. 9 opposed to the caulking portion 133*n*. The groove 33*u* has a depth extending in a thickness direction of the end portion 33*f* of the second joining plate portion 33*d* from the lower surface in FIG. 9, opposed to the caulking portion 133*n*, of the end portion 33*f*.

The caulking portion 133*n* is caulked so as to be crushed to the edge sides of the opening 33*m* in a manner to cause its upper surface in FIG. 9 to have the circular arc shape in section, thereby being joined to the extended portion 33*j*. Therefore, the caulking portion 133*n* serves to improve the joining force between the end portion 33*f* of the second joining plate portion 33*d* and the extended portion 33*j* serving as overlapping portions cooperatively forming an overlapped and joined portion of a shell body portion 33.

Third Embodiment

Figure 10:
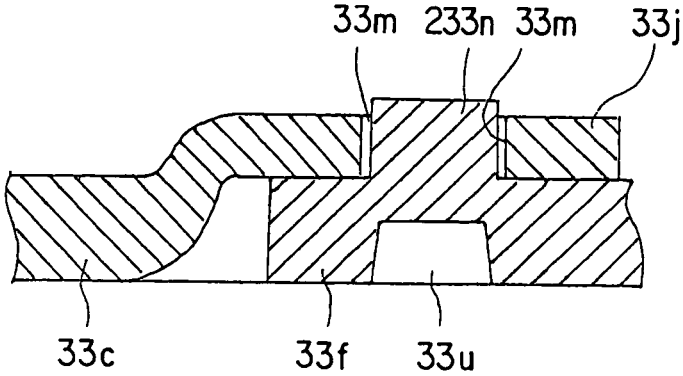
FIG. 10 is a sectional view showing an electrical connector of a third embodiment according to this invention, wherein there is shown a modification of the overlapped portion shown in FIGS. 6 to 8.
Figure 11:
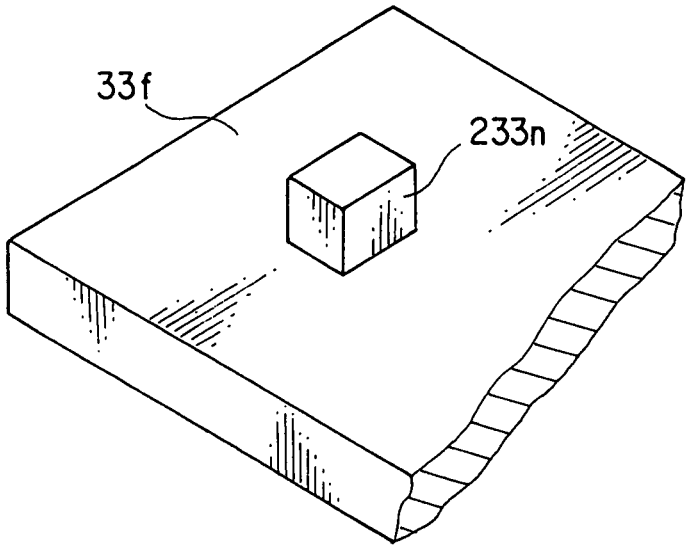
FIG. 11 is a perspective view showing an end portion of a second joining plate portion and a caulking portion shown in FIG. 10.
Figure 12:
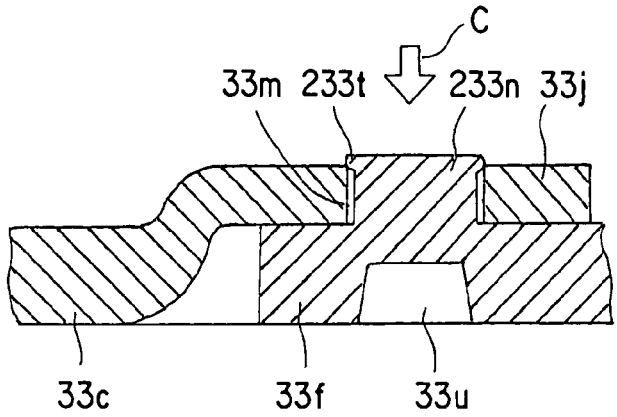
FIG. 12 is a sectional view showing an engaged state of an overlapped portion of the electrical connector shown in FIG. 10.

FIGS. 10 to 12 show a connector of a third embodiment according to this invention. The third embodiment includes a modification of the caulking portion 33*n* formed at the end portion 33*f* of the second joining plate portion 33*d*, which is shown in FIGS. 6 to 8 of the first embodiment.

As shown in FIGS. 10 and 11, an end portion 33*f* of a second joining plate portion 33*d* is formed with a rectangular parallelepiped caulking portion 233*n*. The caulking portion 233*n* is inserted in an opening 33*m* formed in an extended portion (a first overlapping portion) 33*j* of a first joining plate portion 33*c*. The end portion (a second overlapping portion) 33*f* of the second joining plate portion 33*d* is formed with a groove 33*u* on its lower surface in FIG. 10 opposed to the caulking portion 233*n*. The groove 33*u* has a depth extending in a thickness direction of the end portion 33*f* from its lower surface.

The caulking portion 233*n* is crushed by pressing a jig (not shown) downward against an upper surface in FIG. 12 of the caulking portion 233*n* in a direction indicated by an arrow C in FIG. 12. In this event, escaped portions 233*t* of the caulking portion 233*n* after the crushing move to the edge sides of the opening 33*m*. The opening 33*m* and the caulking portion 233*n* engage with each other. Therefore, the escaped portions 233*t* serve to improve the joining force between the end portion 33*f* of the second joining plate portion 33*d* and the extended portion 33*j* serving as overlapping portions.

Fourth Embodiment

Figure 13:
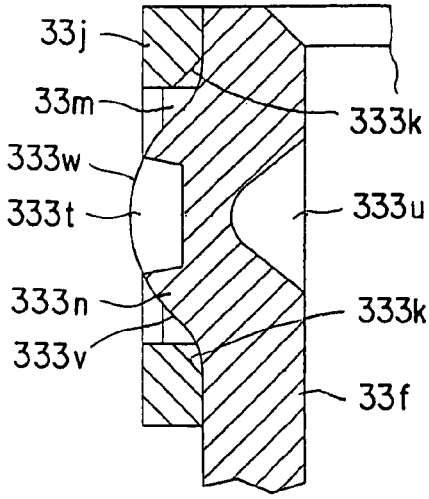
FIG. 13 is a sectional view showing an electrical connector of a fourth embodiment according to this invention, wherein there is shown a modification of the overlapped portion shown in FIGS. 6 to 8.
Figure 14:
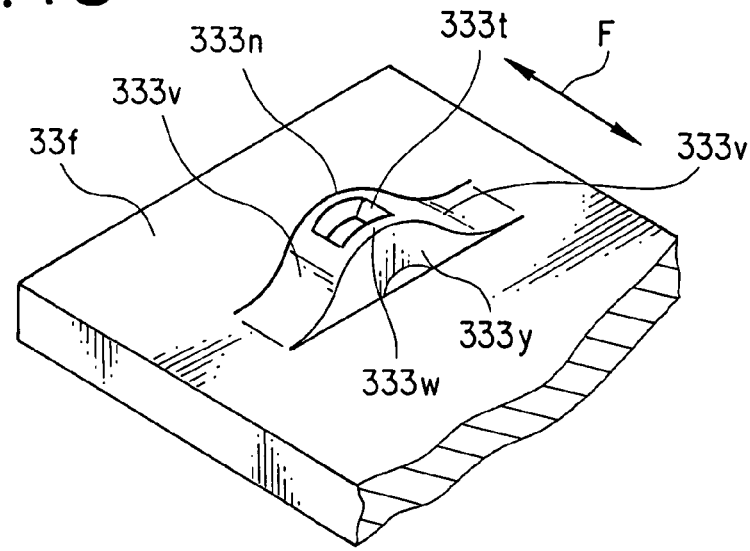
FIG. 14 is a perspective view showing an end portion of a second joining plate portion and a caulking portion shown in FIG. 13.

FIGS. 13 and 14 show a connector of a fourth embodiment according to this invention. The fourth embodiment includes a modification of the caulking portion 33*n* formed at the end portion 33*f* of the second joining plate portion 33*d*, which is shown in FIGS. 6 to 8 of the first embodiment. FIG. 13 shows a section taken in a direction the same as that of FIG. 8 which is taken along line B-B in FIG. 6.

As described in the first embodiment, an end portion 33*e* of a first joining plate portion 33*c* is formed with an extended portion (a first overlapping portion) 33*j* in a second joining portion. The extended portion 33*j* and an end portion (a second overlapping portion) 33*f*, facing the extended portion 33*j*, of a second joining plate portion 33*d* are overlapped with each other.

The extended portion 33*j* is part of the end portion 33*e* of the first joining plate portion 33*c*. The extended portion 33*j* overlaps to cover part of the end portion 33*f* of the second joining plate portion 33*d*. The extended portion 33*j* is formed with an opening 33*m*. The end portion 33*f* of the second joining plate portion 33*d* is formed with a convex caulking portion 333*n* projecting upward. The opening 33*m* has chamfered portions 333*k*. The chamfered portions 333*k* are formed by expanding inner walls, facing the caulking portion 333*n*, of the opening 33*m* on its lower edge side. The caulking portion 333*n* is inserted in the opening 33*m*. The caulking portion 333*n* is caulked at the opening 33*m* so that the caulking portion 333*n* and the extended portion 33*j* engage with each other. Each chamfered portion 333*k* of the opening 33*m* is in the form of a tapered surface sloping planarly or a curved surface formed by a tapered surface sloping with gentle curve.

An upper surface in FIG. 14 of the caulking portion 333*n* has a surface 333*w* of a circular arc shape in section and a pair of chamfered portions 333*v* continuous with both sides of the surface 333*w*. Each chamfered portion 333*v* is gently curved and continuous with an upper surface in FIG. 14 of the end portion 33*f* of the second joining plate portion 33*d*. That is, each chamfered portion 333*v* is a portion formed at the root of the caulking portion 333*n*. Therefore, each chamfered portion 333*v* is in the form of a tapered surface sloping planarly or a curved surface formed by a tapered surface sloping with gentle curve.

A caulking groove 333*t* is formed on the upper surface in FIG. 14 of the caulking portion 333*n*. The end portion 33*f* of the second joining plate portion 33*d* is formed with a groove 333*u* having a depth extending in a thickness direction of the end portion 33*f* from its lower surface in FIG. 14 opposed to the caulking portion 333*n*.

The caulking portion 333*n* is formed by, as a first process, forming two mutually parallel slits each passing through the upper and lower surfaces in FIG. 14 of the end portion 33*f* of the second joining plate portion 33*d*. In a second process, a portion, between the two slits, of the end portion 33*f* is pushed upward from its lower surface in FIG. 14 using a press die. In this event, plate thickness surfaces 333*y* being part of sheared surfaces of the end portion 33*f* are exposed above the upper surface in FIG. 14 of the end portion 33*f*. Further, in the second process, when the caulking portion 333*n* is inserted into the opening 33*m*, the chamfered portions 333*v* are gently curved so as to be positioned in the opening 33*m*. In this event, the chamfered portions 333*v* are not brought into contact with the chamfered portions 333*k* of the opening 33*m*.

By caulking the caulking portion 333*n* in directions indicated by arrows F shown in FIG. 14, the caulking groove 333*t* serves to join the opening 33*m* and the caulking portion 333*n* to each other.

The caulking portion 333*n* serves to improve the joining force between the end portion 33*f* of the second joining plate portion 33*d* and the extended portion 33*j* serving as overlapping portions cooperatively forming an overlapped and joined portion of a shell body portion 33. That is, the sheared surfaces of the caulking portion 333*n* in the directions, indicated by the arrows F shown in FIG. 14, of opening the shell body portion 33 are maintained as they are. Further, in the caulking portion 333*n*, the surface perpendicular to the directions F is formed as the gently-sloping chamfered portions 333*v*. Therefore, the caulking portion 333*n* can improve the strength of the overall shell structure.

Accordingly, at the time of fitting to a mating connector, it is possible to prevent the caulking portion 333*n* from coming off due to deformation of a shell 31 caused by a load such as a pinch force applied to the shell 31.

In the electrical connector in each of the foregoing embodiments, the strength of the shell can be improved by providing the overlapping portions at both ends of the shell body portion and joining them together in the overlapped manner with the formation of the joining portion.

Therefore, it is possible to improve the strength of the connector against a pinch force applied to the shell at the time of the fitting.

Further, by reducing the thickness of one of both end portions of the shell and joining them together using the opening and the caulking portion at the overlapped portion, the processing of the shell can be facilitated.

The foregoing electrical connectors are also applicable to uses such as interface connectors requiring high-speed transmission and electrical connectors for EMI countermeasure.

What is claimed is:

1. An electrical connector comprising a contact, a housing holding said contact, and a shell covering said contact and said housing, wherein said shell comprises:

a shell body portion which extends around said housing to have a first and a second end portions; and a joining portion which joins said first and said second end portions to each other, wherein said joining portion comprises:

a first overlapping portion which extends from said first end portion and has an inner wall defining an opening; and a second overlapping portion which extends from said second end portion and is overlapped with said first overlapping portion to face the opening, wherein said second overlapping portion comprises a caulking portion which is caulked to be inserted in said opening and is engaged with said inner wall, wherein said inner wall comprises a chamfered portion which is adjacent to the second overlapping portion, and wherein said caulking portion comprises:

a pair of chamfered portions which face said chamfered portion of the inner wall and each of which is formed to have a curved surface sloping with gentle curve, and a surface which is continuous between said chamfered portions of the caulking portion has a circular arc shape in section.

2. An electrical connector according to claim 1, wherein said first and second overlapping portions are different from each other in thickness.

3. An electrical connector according to claim 1, wherein said inner wall and said caulking portion engage with each other by movement of an escaped portion of said caulking portion after crushing thereof to said inner wall.

4. An electrical connector according to claim 1, wherein said chamfered portion of the caulking portion is formed at the root of said caulking portion.

5. An electrical connector according to claim 1, wherein said shell further comprises an additional joining portion which serves to join the first and the second end portions to each other, said additional joining portion comprising:

a projecting portion which projects from said first end portion; and a recessed portion which is formed at said second end portion and engaged with said projecting portion.

* * * * *